US006582821B1

(12) United States Patent
Gilbert

(10) Patent No.: US 6,582,821 B1
(45) Date of Patent: Jun. 24, 2003

(54) CAST COATED SHEET AND METHOD OF MANUFACTURE

(75) Inventor: Paul G. Gilbert, Augusta, ME (US)

(73) Assignee: S. D. Warren Services Company, Boston, MA (US)

( * ) Notice: Subject to any disclaimer, the term of this patent is extended or adjusted under 35 U.S.C. 154(b) by 0 days.

(21) Appl. No.: 09/431,027

(22) Filed: Oct. 29, 1999

(51) Int. Cl.[7] ..... B32B 23/08; B32B 27/10

(52) U.S. Cl. ..... 428/409; 428/511; 428/512; 428/513; 428/514

(58) Field of Search ..... 428/511, 514, 428/512, 513, 409

(56) References Cited

U.S. PATENT DOCUMENTS

| | | | | |
|---|---|---|---|---|
| 3,028,258 A | | 4/1962 | Rice | 117/64 |
| 4,620,992 A | | 11/1986 | Nojima et al. | 427/362 |
| 5,275,846 A | | 1/1994 | Imai et al. | 427/362 |
| 5,533,244 A | | 7/1996 | Wadzinski | 29/90.1 |
| 6,242,047 B1 | * | 6/2001 | Johnson et al. | 427/361 |

FOREIGN PATENT DOCUMENTS

| | | | |
|---|---|---|---|
| JP | 56-154596 | | 11/1981 |
| JP | 56154596 | | 11/1981 |
| JP | 63 190 099 A | | 8/1988 |
| JP | 03 260 192 A | | 11/1991 |
| JP | 05 239 799 A | | 9/1993 |
| JP | 05 321 193 A | | 12/1993 |
| JP | 06 158 589 A | | 6/1994 |
| JP | 10-96190 | * | 4/1998 |

OTHER PUBLICATIONS

Brush Calenders for Maintaining Bulk and Obtaining Surface Gloss, apr International, Dec. 1988, pp. 14 and 16 (author unknown).

* cited by examiner

*Primary Examiner*—Monique R. Jackson
(74) *Attorney, Agent, or Firm*—Briana K. O'Regan

(57) ABSTRACT

A cast coated printing sheet providing high paper gloss and smoothness, desirable printing performance characteristics, and enhanced printed product attributes. The cast coated sheet comprises a substrate and a brushed coating layer comprising (a) a pigment, (b) a functionally effective amount of latex such that a dried unbrushed layer of the coating will not adhere sufficiently to the casting surface to allow the unbrushed layer to be cast, and (c) a functionally effective amount of brushing agent such that damage to the coating layer surface during brushing is minimized. The invention further provides methods for manufacturing such cast coated printing sheets.

10 Claims, 2 Drawing Sheets

CAST COATED SHEET AND METHOD OF MANUFACTURE

BACKGROUND OF THE INVENTION

The present invention relates to a cast coated printing sheet. More particularly, the present invention relates to a cast coated printing sheet providing high paper gloss and smoothness, and enhanced printed product attributes. The present invention further relates to a method of manufacturing such a cast coated printing sheet.

There are three conventional casting methods of producing cast coated paper. All three involve pressing a coated substrate against a highly polished heated surface and adhering the coated substrate against the polished surface. The term "casting," as used herein, is intended to mean the step in which a coated substrate is pressed and adhered against the casting surface, regardless of the coated substrate's physical state. The three methods are wet casting, gel casting, and rewet casting. In each case, the surface of the cast coated substrate exhibits the same gloss and smoothness as the highly polished casting surface.

The wet casting method includes (a) applying a coating to one surface of a web substrate, (b) pressing the coated side of the substrate against a casting drum, i.e., a highly polished, smooth cylindrical roll or continuous belt used in the manufacture of web substrates, (c) simultaneously with the pressing step, drying the coated side of the substrate against the casting drum, and (d) stripping the substrate from the casting drum with the dried coating adhered to the substrate. Typically the coated side of the substrate is pressed against the casting drum by means of a press roll. Very low casting drum temperatures, e.g., generally less than about 95° C., are required in the wet casting method to ensure that the adhesion of the coating to the casting drum and the cohesive strength of the coating layer are greater than the vapor pressure of the liquid at the surface of the casting drum.

The gel casting method includes (a) applying a coating layer to one surface of a web substrate, (b) gelling the coating layer, (c) casting the gelled coating layer against a heated casting drum, and (d) stripping the coated substrate from the casting drum with the cast coating adhered to the substrate. Typically, the gelling step may be accomplished by chemically gelling the coating, e.g., by modifying the pH of the wet coating by an acidic or alkaline solution, such as formic acid or calcium formate, or by thermally gelling the coating, e.g., by using convection, conduction or infrared heating. Higher casting surface temperatures may be used in the gel casting method, e.g., up to about 120° C., because the gelled coat has higher cohesive strength than a wet coating.

The rewet casting method includes (a) applying a coating layer to a surface of a web substrate, (b) drying the coating layer, (c) plasticizing the dried coating layer with a rewetting liquid, (d) casting the plasticized coating layer against a casting drum, and (e) stripping the coated substrate from the casting drum with the cast coating adhered to the substrate. The rewetting liquid is typically applied to the coated substrate in the nip formed between the press roll and the casting drum.

In addition to the three conventional casting methods, variations and combinations of these methods are known, e.g., after the gelling step, the gelled side of the substrate is further plasticized with a rewetting liquid in the nip formed between the press roll and the casting drum.

In order to be suitable for use in the processes described above, a coating layer should generally exhibit (a) sufficient adherence to the casting drum during the casting step, (b) moldability to the casting drum, and (c) adequate releasability from the casting drum at the completion of the casting step. Sufficient and uniform adherence to the casting drum ensures high surface gloss and smoothness, which are product attributes demanded by purchasers of cast coated sheets. If the coated substrate does not adhere sufficiently to the casting drum, the vapor pressure at the casting drum surface exiting the nip will typically exceed the adhesion force of the coating layer to the surface, resulting in blistering. If moldability of the coating layer to the casting drum surface is inadequate, pits, i.e., depressions in the surface of the coating layer, will tend to result and the product attributes of the cast surface will be unacceptable. If the release from the casting drum is inadequate, the coated layer of the substrate will tend to stick to the casting drum. The problems caused by inadequate release can range from picking, i.e., localized delamination of the coating layer from the underlying substrate, resulting in nonuniform surface characteristics, to macro-scale lamination of the coated substrate to the casting drum, resulting in unstable manufacturing operations.

To ensure sufficient adherence to the casting drum during the casting step, coating compositions for cast coating typically include high levels of a binder, such as latex and/orcasein. High levels of these materials, especially high levels of latex, can negatively affect releasability from the casting drum, resulting in, e.g., picking, and can deleteriously affect other product attributes, such as ink set time. To counteract excessive adherence to the casting drum, release agents are generally employed. Conventional means of improving releasability include applying a release agent to the surface of the casting drum, and adding a release agent to the coating composition, the gelling liquid and/or the rewetting liquid. Excessive amounts of release agent, however, can affect the aesthetic appearance and the printability of the cast coated sheet.

The coating compositions and the final product attributes have heretofore been constrained by the conventional methods of manufacture. Final product attributes as well as desired performance characteristics during the printing process are often sacrificed to design coating compositions that perform well during the casting process.

SUMMARY OF THE INVENTION

The present invention provides cast coated printing sheets providing high paper gloss and smoothness, desirable printing performance characteristics, and enhanced printed product attributes. Preferred cast coated printing sheets of the invention provide excellent printed product attributes for offset, rotogravure and flexographic printing applications. The invention further provides methods for manufacturing such cast coated printing sheets.

In one aspect, the invention provides a coated sheet for use in a cast coating process, comprising a substrate, and, on at least a first surface of the substrate, a dried coating comprising a latex and a pigment, wherein the latex is present in a functionally effective amount, i.e., an amount of latex that is selected so that a dried, unbrushed layer of the coating will not adhere sufficiently to a casting surface to allow the dried, unbrushed layer to be cast, and wherein an exposed surface of the dried coating has been brushed.

In another aspect, the invention provides a cast coated printing sheet comprising a substrate, and, on at least a first surface of the substrate, a coating comprising a latex and a pigment, wherein the latex is present in a functionally effective amount, and wherein an exposed surface of the coating has been brushed prior to casting.

In another aspect, the invention provides a cast coated printing sheet comprising a substrate, and, on at least a first surface of the substrate, a coating comprising a latex and a pigment, wherein the latex is present in a functionally effective amount, and the cast coated printing sheet has a 20° gloss of greater than about 73.

In another aspect, the invention provides a cast coated printing sheet comprising a substrate, and, on at least a first surface of the substrate, a coating comprising a latex and a pigment, wherein the latex is present in a functionally effective amount, and the cast coated printing sheet has a 20° ink gloss of greater than about 60.

In another aspect, the invention provides a cast coated printing sheet comprising a substrate, and, on at least a first surface of the substrate, a coating comprising a latex and a pigment, wherein the latex is present in a functionally effective amount, and the cast coated printing sheet has a PPS 10 kg Soft of less than about 0.50.

In another aspect, the invention provides a cast coated printing sheet having a 20° gloss of greater than about 90.

The terms "brushed," "brushing," and variations thereof, as used herein, are intended to encompass a mechanical rubbing action on the surface of a substrate, such as the burnishing effect achieved by a buffer, brusher, or a friction calender. The term "brushing agent," as used herein, is intended to encompass materials that enhance the brushability of the coating layer, such as starch, plastic pigment, and polyvinyl alcohol.

Preferred embodiments may include one or more of the following features. The substrate is paper. The casting surface is a casting drum. The pigment is selected from the group consisting of precipitated calcium carbonate, aluminum trihydrate, satin white, high brightness clays and mixtures thereof. The coating further comprises a brushing agent present in a functionally effective amount. The "functionally effective amount" of brushing agent, as used herein, is an amount of brushing agent that is selected so that damage to the dried coating layer during brushing is minimized, i.e., no appreciable dusting occurs during brushing. The coating composition comprises about 5 to 25 parts of latex and about 1 to 30 parts of brushing agent, more preferably about 10 to 20 parts latex and about 3 to 20 parts brushing agent. The term "parts," as used herein, means parts on a dry solids basis, and, as is well known in the art, parts are based on 100 parts of pigment. The latex is selected from the group consisting of styrene butadiene, modified styrene butadiene, styrene acrylate and mixtures thereof. The brushing agent is selected from the group consisting of plastic pigment, starch, polyvinyl alcohol and mixtures thereof. The coating composition comprises about 0.3 to 5.0 parts of a release agent, preferably selected from the group consisting of calcium stearate, polyethylene emulsion, beef tallow and mixtures thereof. The cast coated printing sheet is suitable for offset printing applications.

In another aspect, the invention provides a method of forming a coated substrate for use in a casting process comprising:

a) providing a substrate having a coated surface that comprises a dried coating that would not adhere to a casting surface sufficiently to perform a casting operation on the coating; and b) brushing the dried coating to a sufficient extent so that the coating will adhere to the casting surface sufficiently to perform the casting operation on the coating.

In another aspect, the invention provides a method of forming a cast coated printing sheet comprising:

a) providing a substrate having a coated surface comprising a dried coating that, as dried, would not adhere to a casting surface sufficiently to perform a casting operation on the coating;

b) brushing the dried coating to a sufficient extent so that the coating will adhere to the casting surface sufficiently to perform the casting operation on the coating; and c) after brushing, casting the coated surface.

In another aspect, the invention provides a method of forming a cast coated printing sheet comprising:

a) providing a substrate having a coated surface comprising a dried coating that, as dried, would not adhere to a casting surface sufficiently to perform a casting operation on the coating;

b) brushing the dried coating, wherein the net specific brushing intensity applied to the dried coating is about 0.002 to 0.1 kW hr/m$^2$; and c) after brushing, casting the coated surface.

Preferred methods may include one or more of the following features. The casting step is achieved by plasticizing the brushed coating with a rewetting liquid and by pressing the plasticized coating against a casting surface. A calendering step is performed before or after the brushing step, more preferably before the brushing step. The brushing step is performed by a brusher. The net specific brushing intensity is about 0.005 to 0.07 kW hr/m$^2$. The casting surface is a casting drum. Steps (a) through (c) are repeated on a second opposite side of the substrate to create a cast surface on the second side of the substrate. More preferably, step (a) is performed on the first side and then repeated on the second side, then steps (b) and (c) are performed on the first side and then repeated on the second side. Most preferably, the calendering step is performed on both sides of the substrate before the brushing step.

In another aspect, the invention provides a method of printing comprising:

a) providing a cast coated printing sheet comprising a substrate, and, on at least a first surface of the substrate, a coating comprising a latex and a pigment, wherein the latex is present in a functionally effective amount, and wherein an exposed surface of the coating has been brushed prior to casting; and b) printing an image on the printing sheet utilizing a printing press.

The term "image," as used herein, is intended to encompass any textual or pictorial image. Preferably the printing press includes offset, rotogravure and flexographic printing presses.

Other features and advantages of the invention will be apparent from the following detailed description, the drawings, and the claims.

DETAILED DESCRIPTION OF PREFERRED EMBODIMENTS

Figure 1:
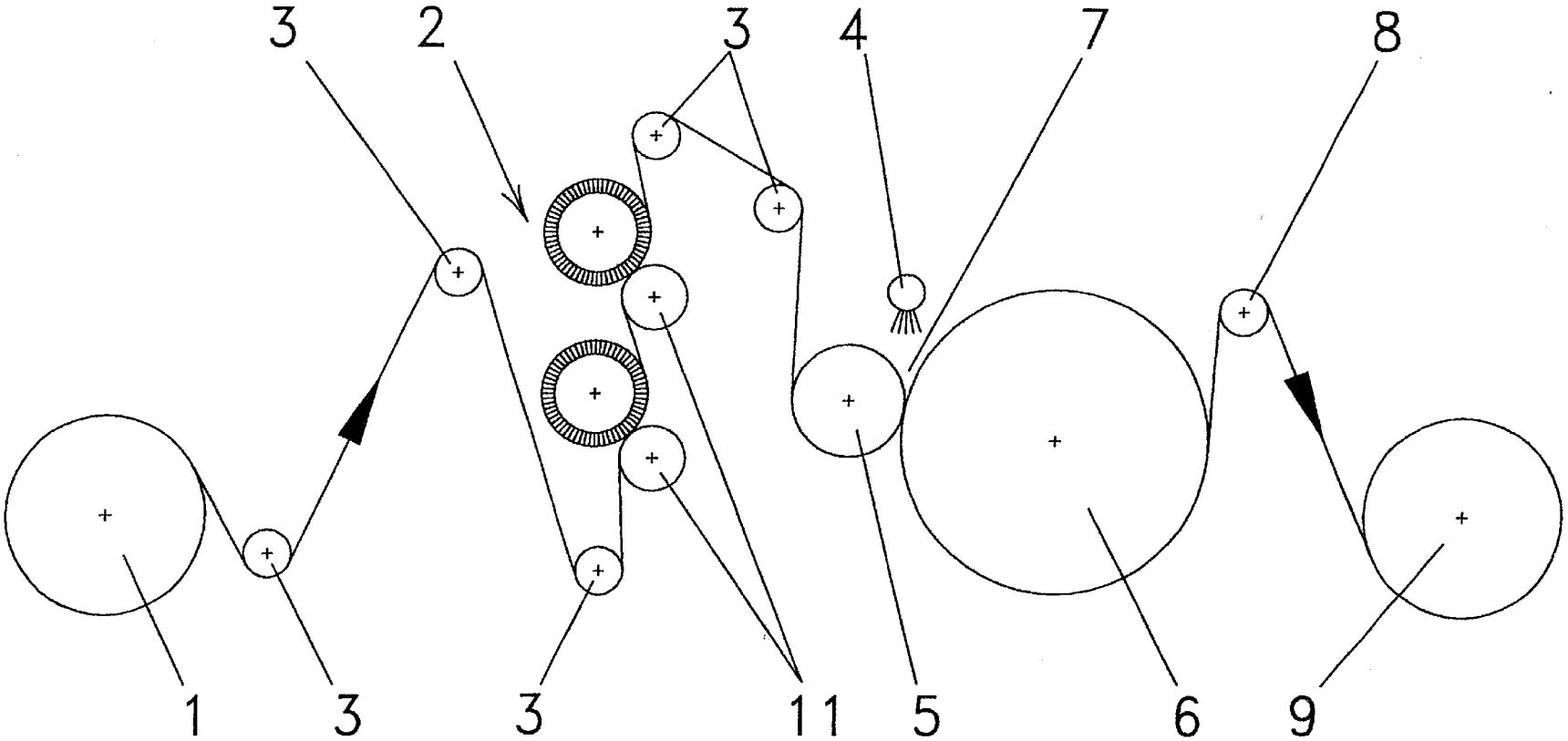
FIG. 1 is a schematic side view of an embodiment of the cast coating process of the invention.

The cast coated printing sheet of the invention includes a substrate and a coating which includes a pigment, a functionally effective amount of latex, and a functionally effective amount of brushing agent, wherein the dried layer of coating is brushed prior to casting.

In order for the brushed coating layer to perform well during a casting process, the amount of latex in the coating should fall within a specific range, which is determined based on (a) the properties and composition of the latex, and (b) the adherence of the coating layer to the casting drum without brushing.

If the amount of latex is sufficiently high so that the coating layer would adhere to the casting surface without brushing, the brushed coated layer will generally adhere too strongly to the casting surface, resulting in unacceptable release. If the amount of latex in the coating is too low, the brushed coating layer generally will not adhere properly to the casting surface, resulting in unacceptable final product attributes, e.g., insufficient and nonuniform paper gloss and smoothness. Thus, the amount of latex should generally be selected so that the coating layer will not adhere to the casting surface without brushing and will adhere adequately to the casting surface with brushing.

The amount of latex in the coating also affects the ability of the coating layer to withstand brushing. Depending on the particular coating composition, the functionally effective amount of latex may be adequate to minimize damage to the coating layer surface during brushing, without the further addition of a brushing agent. If, however, a particular coating composition requires more than the functionally effective amount of latex to withstand the effect of brushing, addition of more latex will generally cause the brushed coated layer to adhere too strongly to the casting surface, resulting in unacceptable release. Thus, in this case it is preferred instead to add a brushing agent to enhance brushability, rather than relying on the latex alone to impart sufficient brushability.

Typical monomers used in the production of latex polymers for paper coatings include styrene, butadiene, acrylonitrile, butyl-acrylate, methyl methacrylate, vinyl acrylic, isoprene and combinations thereof. Practitioners skilled in the art are aware of how to select the appropriate latex(es) to achieve the desired final properties. Desired final properties for the cast coated printing sheet of the invention typically require a latex which provides adequate adhesion and sufficient moldability of the coating layer to the surface of the casting surface. Preferably the coating includes about 5 to 25 parts of latex, more preferably about 10 to 20 parts of latex. Preferred latexes include styrene butadiene, modified styrene butadiene, styrene acrylate and mixtures thereof. Examples of suitable latexes include: Dow 620NA, Dow 640NA, and RAP 448 manufactured by The Dow Chemical Company; Gen-Flo 5218, Gen-Flo 8045, and GenCryl 9710, manufactured by Omnova Solutions Inc.; and Acronal S504, Acronal S728, and Styronal 4664 manufactured by BASF Corporation.

The amount of brushing agent included in the coating layer affects the ability of the coating layer to withstand brushing without undesirable dusting or deterioration. If the latex alone does not impart sufficient brushability, a functionally effective amount of a brushing agent is included. A functionally effective amount of brushing agent is required to brush well. If the amount of brushing agent is too low, the brushing action may tend to damage the coating layer, resulting in dust problems during manufacture as well as unacceptable surface quality. If the amount of brushing agent is too high, the ink gloss of the cast coated sheet may be affected deleteriously.

Preferably the coating includes about 1 to 30 parts of brushing agent, more preferably about 3 to 20 parts of brushing agent, selected from the group consisting of plastic pigment, starch, polyvinyl alcohol and mixtures thereof Preferred brushing agents enhance brushability without significantly increasing adhesivity of the coated layer to the casting surface. The brushing agent preferably comprises about 1 to 20 parts of plastic pigment, selected from the group consisting of hollow sphere plastic pigments, solid plastic pigments, and mixtures thereof. Additional amounts of plastic pigment maybe included in the coating to function as a pigment material. Examples of plastic pigments include Ropaque HP-1055, and Ropaque HP-543P, manufactured by Rohm and Haas Company, and Dow 722 manufactured by The Dow Chemical Company.

Suitable pigments include clay, e.g., high brightness clay, ground calcium carbonate, precipitated calcium carbonate, titanium dioxide, aluminum trihydrate, satin white, plastic pigment, silica and mixtures thereof. Practitioners skilled in the art are aware of how to select the appropriate pigment(s) to achieve desired final properties. Preferably, the coating includes at least 60 parts of pigment, more preferably at least 80 parts of pigment.

Preferably, the coating further includes a release agent, which more preferably is selected from the group consisting of calcium stearate, polyethylene emulsion, beef tallow and mixtures thereof. Preferably, the coating composition comprises about 0.3 to 5 parts release agent, more preferably about 0.5 to 2.5 parts. During the cast coating process, the casting surface is typically cleaned or buffed periodically to remove coating build-up. The addition of release agent to the coating prolongs the period between casting surface cleanings. If too little release agent is used, the period between cleanings may be shortened, causing unacceptable manufacturing delays. If too much release agent is used, ink set time may increase to an unacceptable level and the cast surface may appear hazy, an aesthetically undesirable surface effect. Practitioners skilled in the art are aware of how to select the appropriate amount of release agent(s) to achieve acceptable production rates while maintaining acceptable unprinted and printed appearance of the cast coated sheet.

The coating layer may further include additives, such as dispersing agents, thickening agents, colorants, dyes, water retention agents, preservatives, fluorescent brighteners, lubricants and pH control agents. Practitioners skilled in the art are aware of how to select the, appropriate coating additives to meet manufacturing and production objectives and to achieve the desired final product attributes.

The substrate is preferably paper which may further include a precoat or a base coat layer. The paper substrate is preferably of the weight and type suitable for offset printing. The basis weight of suitable substrates typically range from about 60 to 440 g/m$^2$.

The cast coating method of the invention will now be described with reference to FIG. 1. A coated and dried substrate 1 is passed, with the aid of guide rolls 3 and fly rolls 11, through brusher 2, and then through a press nip 7, formed by press roll 5 and a casting drum 6. At the press nip 7, the surface of the coated substrate 1 is plasticized with a rewetting liquid supplied by a nozzle 4. The substrate 1 is removed from the casting drum 6 by a take-off roll 8, thereby obtaining a cast coated substrate 9.

Substrate 1 is formed by applying a pigmented coating layer to a substrate, using an on-machine or off-machine coater. Examples of coating techniques include, but are not limited to, bent blade, bevel blade, rod, roll, short dwell, curtain, air knife, bar, gravure, size press and air brush. Preferably, the coating layer is applied by a bent blade coater. The coating may be applied in one or more layers. Preferably the total coat weight applied is about 5 to 40 g/m$^2$, more preferably about 10 to 30 g/m$^2$. Because high coat weights tend to be more susceptible to poor cross-direction coat weight profiles, the coating is preferably applied at a relatively high solids level of greater than about 60%. The coating layer is then dried, e.g., by convection, conduction, infrared, and combinations thereof Brusher 2 may be a buffer or brusher apparatus which may be a separate apparatus, or a process unit in a continuous line as shown in FIG. 1. Brushing intensity is controlled by three variables: brushing area, i.e., the surface area of the coated substrate in contact with the brushes; brushing force, i.e., the tangential force applied by the brushes against the surface of the coated substrate; and brush speed. The appropriate level of brushing intensity is determined by the composition of the coating and the desired final product attributes. Net specific brushing intensity is calculated from the net power of the brusher motor, the substrate web speed, and the width of the substrate web. Preferably the net specific brushing intensity applied to the substrate is about 0.002 to 0.1 kW hr/m$^2$, more preferably about 0.005 to 0.07 kW hr/m$^2$.

Suitable brushing intensity generally results in a glazed coating layer surface, exhibiting sufficient adhesion to the casting surface. If the brushing intensity is too low, the moldability of the coating layer to the casting surface may be poor, resulting in pits and in unacceptable final product surface characteristics, such as low gloss and print mottle. If the brushing intensity is too high, the coating layer may tend to adhere too strongly to the casting surface, resulting in picking on the casting drum or on the printing press. Excessive brushing intensity may also damage the glazed coated surface, e.g., the surface may appear hazy after casting, an aesthetically undesirable surface effect. Preferably, the brusher 2 employs the area brushing technique wherein a cylindrical brush roll is located between two fly rolls 11, as shown in FIG. 1. The web substrate 1 is guided partially around the brush by the fly rolls 11, resulting in a significant area of contact between the substrate and the brush. Suitable brushers typically have a plurality of brush rolls, e.g., four to eight brush rolls, and are commercially available from DOX Maschinenbau GmbH.

Table 1 below demonstrates the effect of net specific brushing intensity on final product attributes for two coating formulations.

TABLE 1

| | Example A1 | Example A2 | Example B1 | Example B2 |
|---|---|---|---|---|
| Brushing Intensity (kW hr/m$^2$) | 0.01 | 0.0125 | 0.008 | 0.017 |
| 20° Gloss | 91.5 | 93.7 | 73.2 | 73.4 |
| Tobias Microgloss | 118 | 87 | 178 | 152 |
| PPS 10 kg Soft | 0.43 | 0.45 | 0.34 | 0.28 |
| 20° Ink Gloss | 90.9 | 93.3 | 59.4 | 68.4 |
| Ink Film Continuity | 129 | 137 | 155 | 165 |

The measurements for 20° gloss were performed on unprinted paper. Tobias Microgloss is a measure of the point to point variation in gloss, using a 1.5 mm microgloss head in the Tobias Mottle tester. The lower the value, the more uniform is the surface gloss. The measurements for 20° Ink Gloss were performed on a single color ink (magenta) solid image, printed on a commercial offset printing press. The higher the value, the greater is the ink gloss of the printed image. Both the 20° gloss and 20° ink gloss measurements were performed according to Tappi Method T-653. Parker Print Surface (PPS) is a measure of the smoothness of the surface, with a lower value indicating a smoother surface. PPS measurements were performed according to Tappi Method T-555 om-94. Ink Film Continuity is a measure of the uniformity of the ink film, using the Tobias Mottle tester. The Ink Film Continuity measurements were also performed on a single color ink (magenta) solid image, printed on a commercial offset printing press, with a lower value indicating greater uniformity of the ink film.

These properties are typically used to differentiate between cast coated printing sheets, and the values shown in Table 1 for the cast coated printing sheets of the invention are considered very good. The examples demonstrate that, for a given composition, an increased level of brushing intensity tends to improve desired product attributes, e.g., 20° ink gloss. The product attributes improved by increased brushing intensity are generally dependent on the coating components and formulation, and other process variables.

At press nip 7, plasticizing is achieved by applying a rewetting liquid to the dried, brushed coating layer. The rewetting liquid may be supplied by a nozzle 4, as shown in FIG. 1, or other coating technique. The rewetting liquid may be any rewetting liquid that will plasticize the coating layer. Conventional rewetting liquids generally comprise an aqueous solution or emulsion containing 0.01 to 5.0% release agent, such as polyethylene emulsion, calcium stearate, soaps and beef tallow. Preferably, the rewetting liquid is applied at the press nip formed by the press roll 5 and the casting drum 6, as shown in FIG. 1.

The pressing step is achieved by pressing the plasticized coated substrate against the casting surface. The coating layer should adhere sufficiently to the casting surface to be molded by the surface such that the coating layer will exhibit the gloss and smoothness of the surface of the casting surface. The casting surface is preferably a heated drum, more preferably a heated chrome drum. Drum surface temperatures of about 65° to 150° C. are preferred. Preferably a take-off roll 8 is used to strip the cast substrate from the casting drum 6, as shown in FIG. 1.

Figure 2:
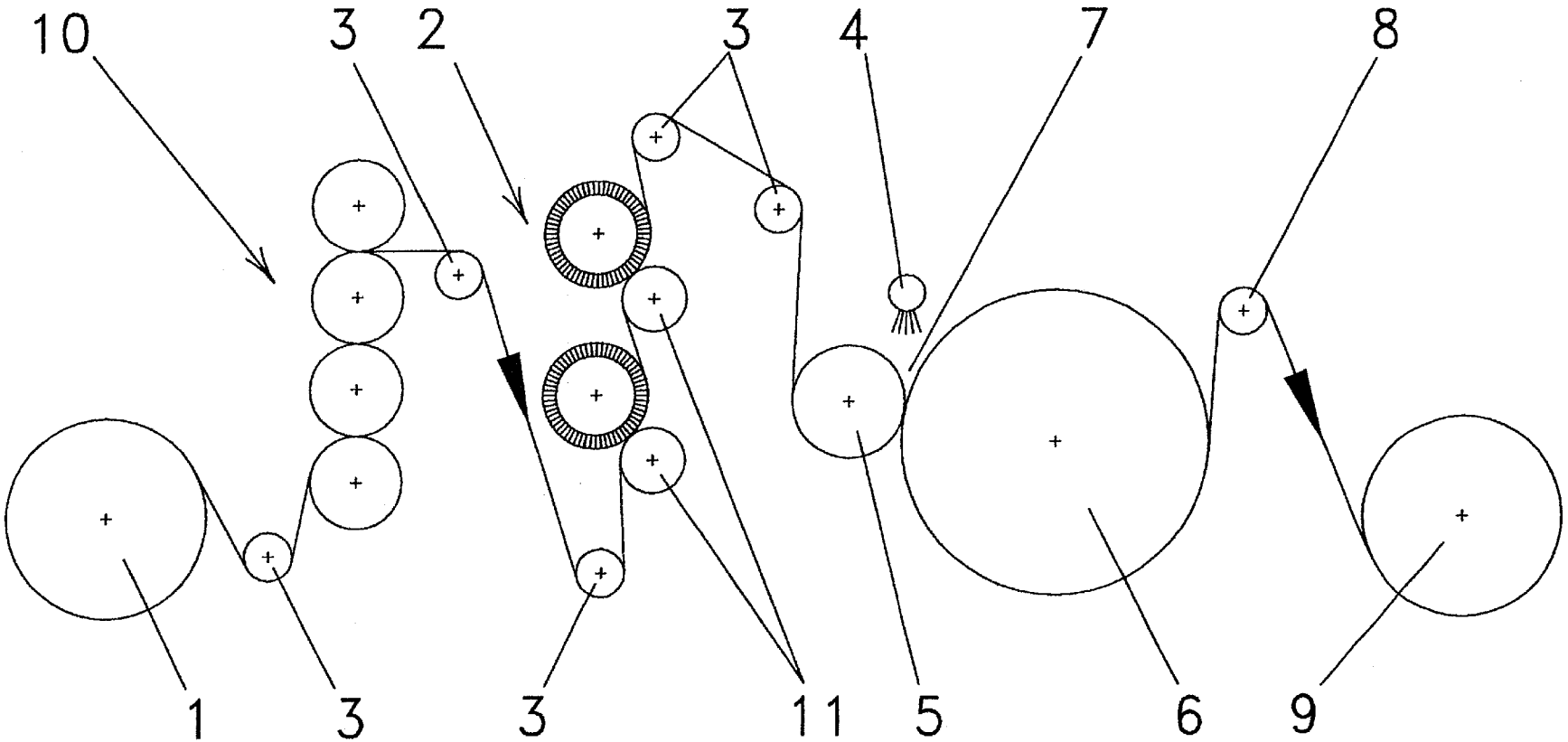
FIG. 2 is a schematic side view of another embodiment of the cast coating process of the invention.

A calendering step may be performed before or after the brushing step, most preferably before the brushing step. The calendering apparatus may be a separate supercalender or an on-line machine calendering unit. Referring to FIG. 2, the coated and dried substrate 1 is passed, with the aid of guide rolls 3, first through a calender 10. The substrate 1 is then passed, with the aid of guide rolls 3 and fly rolls 11, through a brusher 2. The brushed substrate enters a press nip 7, formed by a press roll 5 and a casting drum 6. At the press nip 7, the surface of the coated substrate 1 is plasticized with a rewetting liquid supplied by a nozzle 4. The substrate 1 is removed from the casting drum 6 by a take-off roll 8, thereby obtaining a cast coated substrate 9.

For a two-sided cast coated sheet, the substrate is first coated and dried on both sides. Then, the substrate is brushed and cast on one side of the substrate, and then brushed and cast on the other side of the substrate. Preferably the substrate is calendered on both sides after it has been coated and dried, and before brushing.

EXAMPLES

Table 2 below provides coating formulations and final product attribute data for three embodiments of the invention. In all cases, the paper was calendered and brushed before casting.

TABLE 2

| | Coating A | Coating B | Coating C |
|---|---|---|---|
| Coating Component | | | |
| Total Pigment | 94 | 90 | 94 |
| Clay[1] | 24 | 10 | 64 |
| Total Brushing Agent[2] | 8 | 10 | 8 |
| Starch | 2 | 0 | 2 |
| Plastic Pigment | 6 | 10 | 6 |
| Latex | 15 | 15 | 14 |
| Product Attribute | | | |
| 20° Gloss | 93.7 | 98.9 | 73.4 |
| Tobias Microgloss | 87 | 164 | 152 |
| PPS 10 kg Soft | 0.45 | 0.37 | 0.28 |
| 20° Ink Gloss | 93.3 | 93.3 | 68.4 |
| Ink Film Continuity | 137 | 127 | 165 |

Note:
[1]The clay component is part of the total amount of pigment.
[2]The amount of brushing agent is the total of starch and plastic pigment.

The tests listed in Table 2 are described above with reference to Table 1. The final product attribute values shown in Table 2 are considered very good for cast coated printing sheets. The 20° Ink Gloss data is particularly notable because the samples were printed and measured under actual commercial printing conditions. The values also show that the pigment component of the coating affects final product attributes, e.g., higher levels of clay tend to affect gloss values.

Other embodiments are within the claims. Various modifications of this invention will become apparent to those skilled in the art without departing from the scope or spirit of this invention.

What is claimed is:

1. A cast coated printing sheet having a 20° gloss of greater than 90.

2. A cast coated printing sheet comprising a substrate, and, on at least a first surface of the substrate, a coating layer comprising a latex and an inorganic pigment, wherein the latex is present in a functionally effective amount, and the cast coated printing sheet has a 20° ink gloss of greater than 60.

3. A cast coated printing sheet comprising a substrate, and, on at least a first surface of the substrate, a coating layer comprising a latex and an inorganic pigment, wherein the latex is present in a functionally effective amount, and the cast coated printing sheet has a PPS 10 kg Soft of less than 0.50.

4. A cast coated printing sheet comprising a substrate, and, on at least a first surface of the substrate, a coating layer comprising a latex, a brushing agent and an inorganic pigment, wherein the latex is present in an amount such that, without brushing, the coating layer when plasticized will not adhere sufficiently to a casting surface to allow the plasticized coating layer to be cast, and the brushing agent is present in a sufficient amount such that damage to an exposed surface of the coating layer is minimized during a brushing treatment, wherein the surface of the coating layer undergoes such brushing treatment prior to plasticization and casting and, as a result of such brushing treatment, adheres sufficiently to the casting surface to be cast, and wherein the cast coated printing sheet has a 20° gloss of greater than 90.

5. The cast coated printing sheet of claim 2, 3, or 4 wherein the coating layer comprises at least 60 parts of inorganic pigment and about 5 to 25 parts of latex.

6. The cast coated printing sheet of claim 5 wherein the latex is selected from the group consisting of styrene butadiene, modified styrene butadiene, styrene acrylate and mixtures thereof.

7. The cast coated printing sheet of claim 2, 3 , or 4 wherein the coating layer comprises about 1 to 30 parts of brushing agent.

8. The cast coated printing sheet of claim 7 wherein the coating layer further comprises about 0.3 to 5.0 parts of release agent.

9. The cast coated printing sheet of claim 7 wherein the coating layer comprises at least 80 parts of inorganic pigment, about 10 to 20 parts of latex, about 3 to 20 parts of brushing agent, and about 0.5 to 2.5 parts of release agent.

10. The cast coating printing sheet of claim 7 wherein the brushing agent is selected from the group consisting of plastic pigment, starch, polyvinyl alcohol and mixtures thereof.

* * * * *